US007753363B2

(12) United States Patent
Liu et al.

(10) Patent No.: US 7,753,363 B2
(45) Date of Patent: Jul. 13, 2010

(54) PAPER FEEDING DEVICE

(75) Inventors: Chia-Chih Liu, Hsinchu (TW); Chih-Ming Lin, Hsinchu (TW); Huan-Hsing Hsiao, Hsinchu (TW)

(73) Assignee: Foxlink Image Technology Co., Ltd., Hsinchu (TW)

( * ) Notice: Subject to any disclaimer, the term of this patent is extended or adjusted under 35 U.S.C. 154(b) by 415 days.

(21) Appl. No.: 11/746,611

(22) Filed: May 9, 2007

(65) Prior Publication Data

US 2008/0277864 A1 Nov. 13, 2008

(51) Int. Cl.
*B65H 3/52* (2006.01)

(52) U.S. Cl. ..... 271/121; 271/117

(58) Field of Classification Search ..... 271/117, 271/121

See application file for complete search history.

(56) References Cited

U.S. PATENT DOCUMENTS 5,209,591 A * 5/1993 Mizutani et al. ..... 400/645
5,915,684 A * 6/1999 Nakagawa et al. ..... 271/110
6,152,631 A * 11/2000 Park ..... 400/708
6,392,763 B1 * 5/2002 Nishinohara et al. ..... 358/496
6,792,241 B2 * 9/2004 Nakagawa et al. ..... 399/367
7,255,339 B2 * 8/2007 Hung et al. ..... 271/122
7,320,462 B2 * 1/2008 Takamatsu ..... 271/3.14
2002/0074711 A1 * 6/2002 Higaki ..... 271/117
2002/0096819 A1 * 7/2002 Fukasawa et al. ..... 271/121
2004/0188918 A1 * 9/2004 Morimoto et al. ..... 271/121
2005/0184449 A1 * 8/2005 Morimoto et al. ..... 271/118
2005/0225022 A1 * 10/2005 Akiyama et al. ..... 271/10.03
2006/0049572 A1 * 3/2006 Miyazawa ..... 271/121
2008/0054549 A1 * 3/2008 Lee ..... 271/117

* cited by examiner

*Primary Examiner*—Patrick Mackey
*Assistant Examiner*—Prasad V Gokhale
(74) *Attorney, Agent, or Firm*—Birch, Stewart, Kolasch & Birch, LLP

(57) ABSTRACT

A paper feeding device includes a cover, a base, a pickup roller assembly and at least one paper blocking unit. The paper blocking unit is placed beside the pickup roller assembly, has a paper blocking element and a projection projecting from the upper portion of the side wall of the pickup roller assembly. The paper blocking element includes a connecting portion, a paper blocking arm, a pivot rotatablely connecting the cover. A connecting arm extends upwards from the end of the pivot, a blocking portion projects from the outer side of the connecting arm, a passage is formed between the blocking portion and the connecting arm. The projection can be downward against the blocking portion of the paper blocking element or pass through the passage of the paper blocking element to allow the paper to be fed in, so the cooperation is easy, the paper feeding device works smoothly.

4 Claims, 8 Drawing Sheets

PAPER FEEDING DEVICE

BACKGROUND OF THE INVENTION

1. Field of the Invention

The present invention relates to a paper feeding device, and more particularly to a paper feeding device having a paper blocking unit applied in an office business machine.

2. The Related Art

Recent business machines, such as a scanner, a printer, a copier, etc., are broadly required in the office operation. The business machine has a function of image disposing. Take a conventional scanner as an example, an image disposing system of the scanner includes a glass plate, an optical system arranged under the glass plate for reading the image of the paper placed on the glass plate. As a result of the application of the ADF (automatic document feeder), a stack of papers are placed in a paper tray of the ADF, then the papers are fed into the scanner one by one and placed on the glass plate by a paper feeding device of the ADF, at last, the optical system reads the image of the paper.

In the conventional scanner, the paper feeding device further comprises a paper blocking unit, which is used to make sure that the paper is placed in a proper position before being picked by the paper feeding device, thereby, the paper is picked by a pickup roller of the paper feeding device.

Please refer to FIGS. 1-2, a conventional paper feeding device 1' having a paper blocking unit includes a separating roller 10', a pickup roller 20', a blocking unit 30' and a blocking arm 40'. The separating roller 10' and the pickup roller 20' are parallel to each other and located in a roller frame 50', the blocking unit 30' sleeves on the shaft of the pickup roller 20'. The blocking arm 40' is located on the roller frame 50'. Before the paper being picked, a blocking projection 41' of the blocking arm 40' leans against a stopping projection 31' of the blocking unit 30', the papers 2' are stopped outside, the pickup roller 20' keeps a certain distance from the papers 2'. Then referring to FIG. 2, when the paper 2' is to be picked, the roller frame 50' drives the pickup roller 20' to move downwards, the blocking arm 40' rotates and the blocking projection 41' impels the stopping projection 31' of the blocking unit 30' to move upwards, as a result, the blocking arm 40' loses the cooperation with the blocking unit 30', then the papers 2' are not stopped by the blocking arm 40'. At the same time, the pickup roller 20' contacts with the paper 2' and the paper 2' are fed into the scanner one by one via the paper feeding device 1'.

As described above, the blocking projection 41' impels the stopping projection 31' of the blocking unit 30' to move upwards, thereby, the blocking arm 40' loses the cooperation with the blocking unit 30', then the paper 2' are not stopped by the blocking arm 40' and fed into the scanner one by one. However, the cooperation between the blocking arm 40' and the blocking unit 30' is liable to be lost, then the blocking projection 41' isn't able to impel the stopping projection 31' to move. Consequently, the paper 2' isn't able to be fed into the paper feeding device 1', so the paper feeding device 1' can not work smoothly.

SUMMARY OF THE INVENTION

Accordingly, an object of the present invention is to provide a paper feeding device, comprising a cover, a base, a pickup roller assembly and at least one paper blocking unit placed beside the pickup roller assembly. The base has a paper loading base at the front portion for loading papers, the cover covers on the base. The pickup roller assembly has two side walls. The pickup roller assembly picks up and then transfers the paper into the paper feeding device. The paper blocking unit has a paper blocking element and a projection projecting from the upper portion of the side wall of the pickup roller assembly. The paper blocking element includes a connecting portion, a pivot projects outward from the two opposite sides of the connecting portion and rotatablely connecting the cover, a connecting arm extends upwards from the outer end of the pivot, a blocking portion projects outwards from the outer side of the top end of the connecting arm, a passage is formed between the blocking portion and the connecting arm, and a paper blocking arm extends downwards from the connecting portion. The projection can downward against the blocking portion or pass through the passage of the paper blocking element.

As described above, the paper feeding device stops the paper by the cooperation between the paper blocking element and the projection. When to feed papers, the projection passes through the opening of the blocking element to allow the paper to be fed in, so the cooperation is easy, the paper feeding device works successfully.

BRIEF DESCRIPTION OF THE DRAWINGS

The present invention will be apparent to those skilled in the art by reading the following description of a preferred embodiment thereof, with reference to the attached drawings, in which:

FIG. 6 is a perspective view of a cover with the pickup roller assembly and the paper blocking element assembled in;

DETAILED DESCRIPTION OF THE PREFERRED EMBODIMENT

Figure 3:
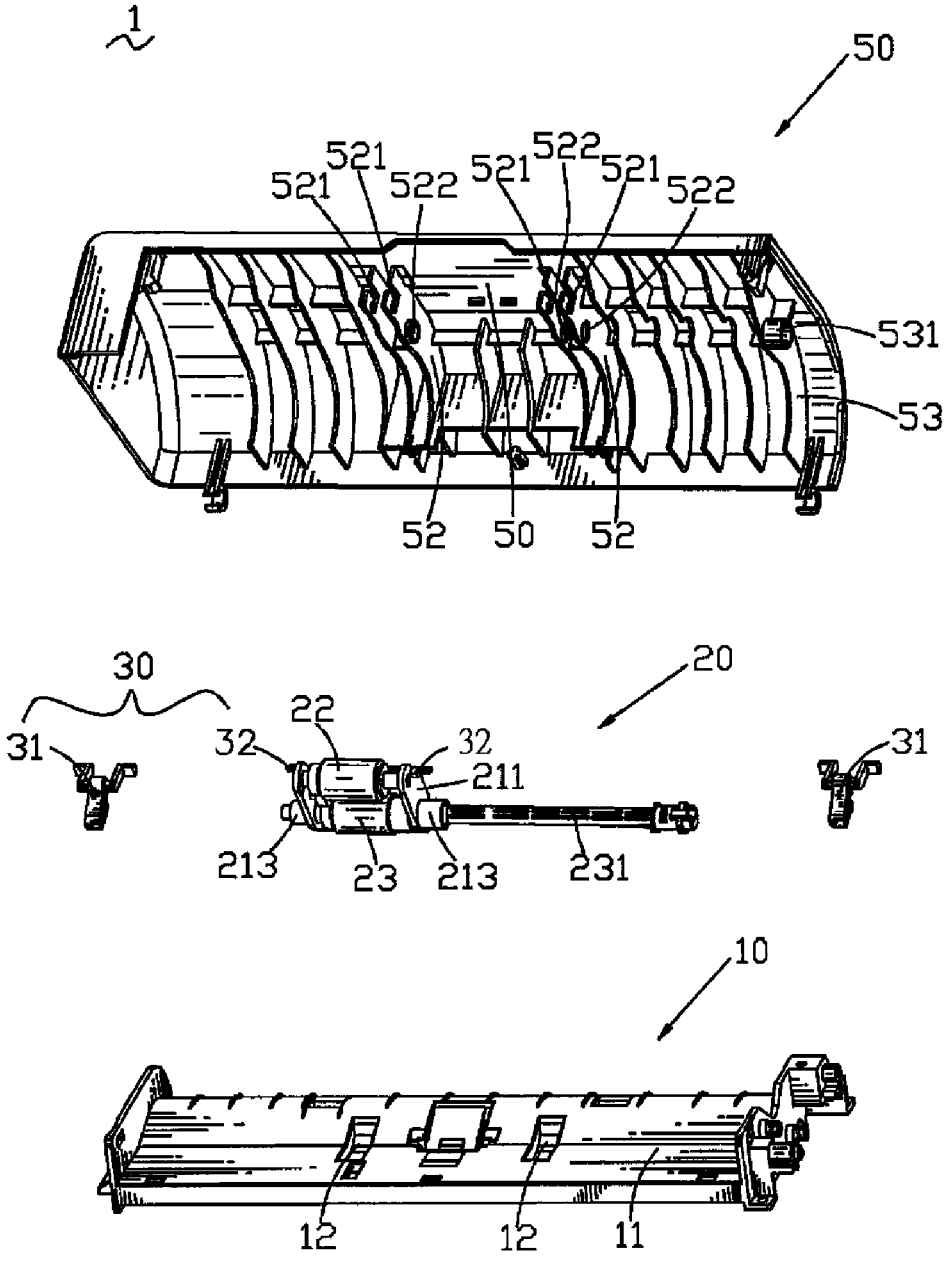
FIG. 3 is an exploded perspective view of a paper feeding device of the present invention.

Please refer to FIG. 3, a paper feeding device 1 of the present invention includes a base 10, a pickup roller assembly 20, a paper blocking unit 30, and a cover 50. The pickup roller assembly 20 and the paper blocking unit 30 are both assembled in the cover 50, the cover 50 is covered on the base 10.

Figure 1:
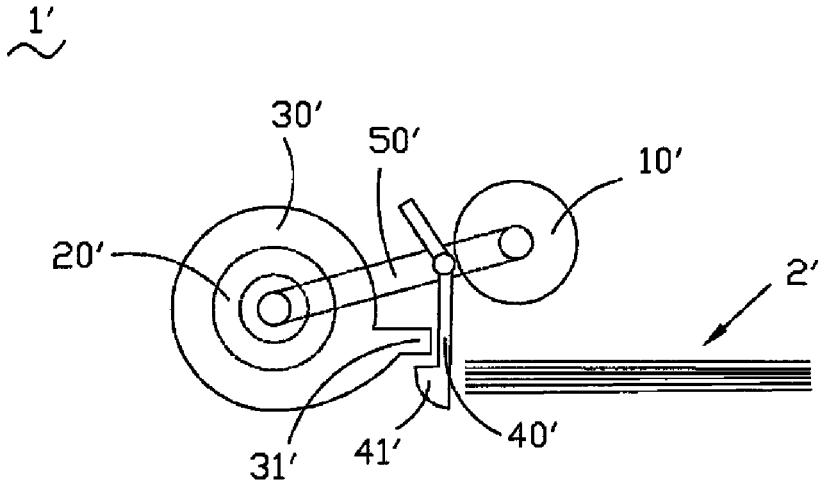
FIG. 1 (PRIOR ART)
FIGS. 1-2 show a conventional paper feeding device.
Figure 2:
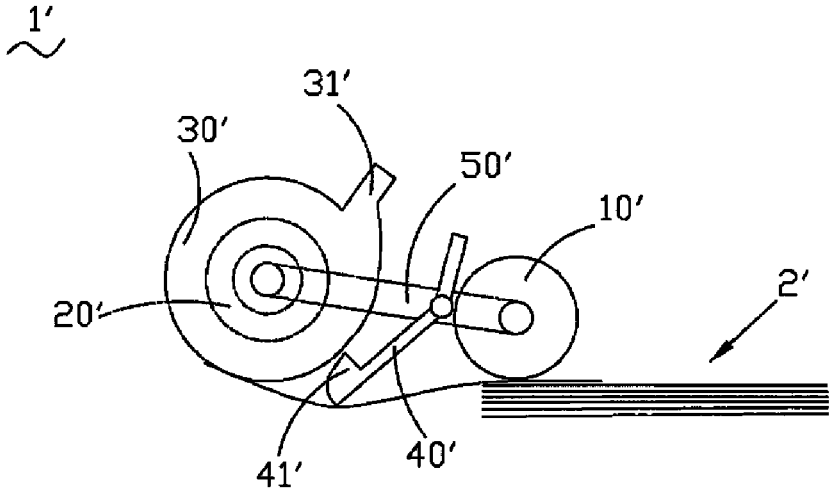
FIG. 2 (PRIOR ART)
Figure 6:
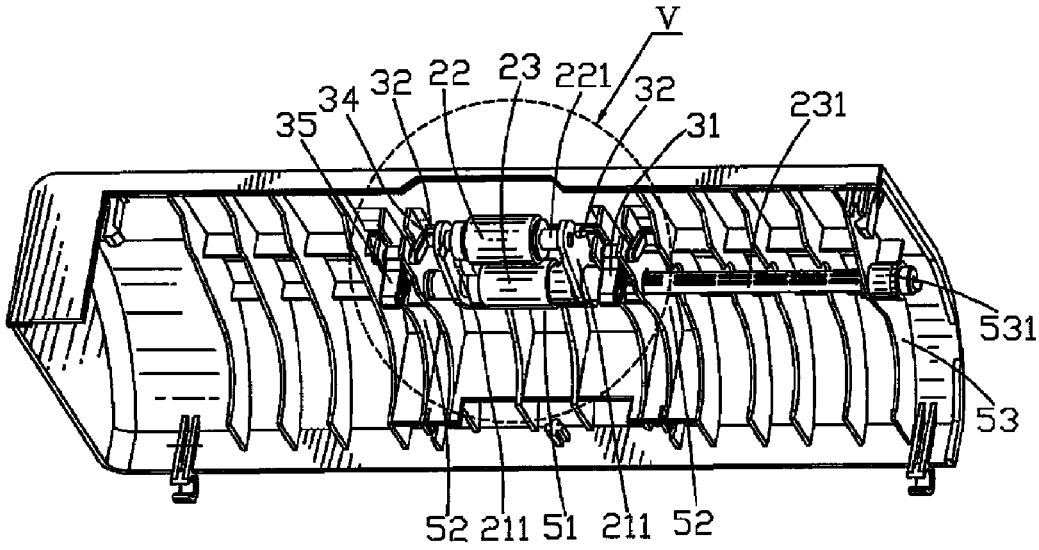
Figure 7:
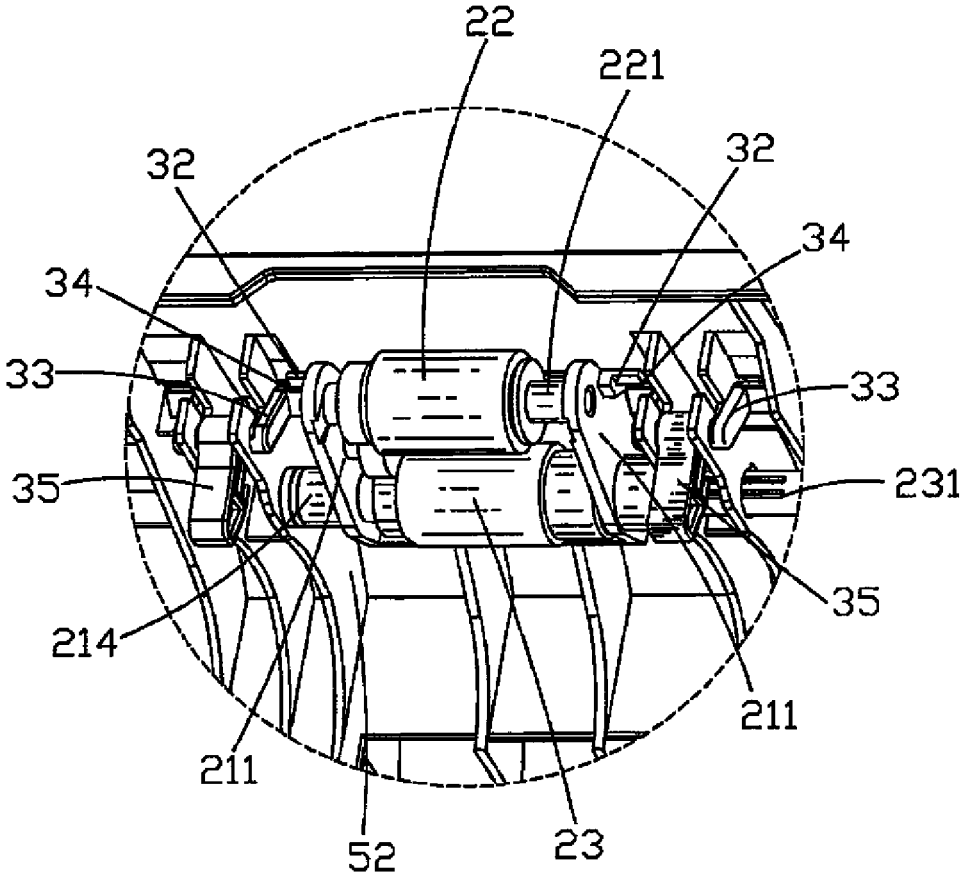
FIG. 7 is a partial enlarged view of an encircled portion labeled V shown in FIG. 6.

Referring to FIG. 1 in combination with FIG. 6, a paper loading base 11 is formed at the front portion of the base 10 for loading paper, a paper transporting passage 13 is formed between the rear portions of the base 10 and the cover 50. A pair of long cavities 12 are lengthwise opened in the paper loading base 11.

Figure 4:
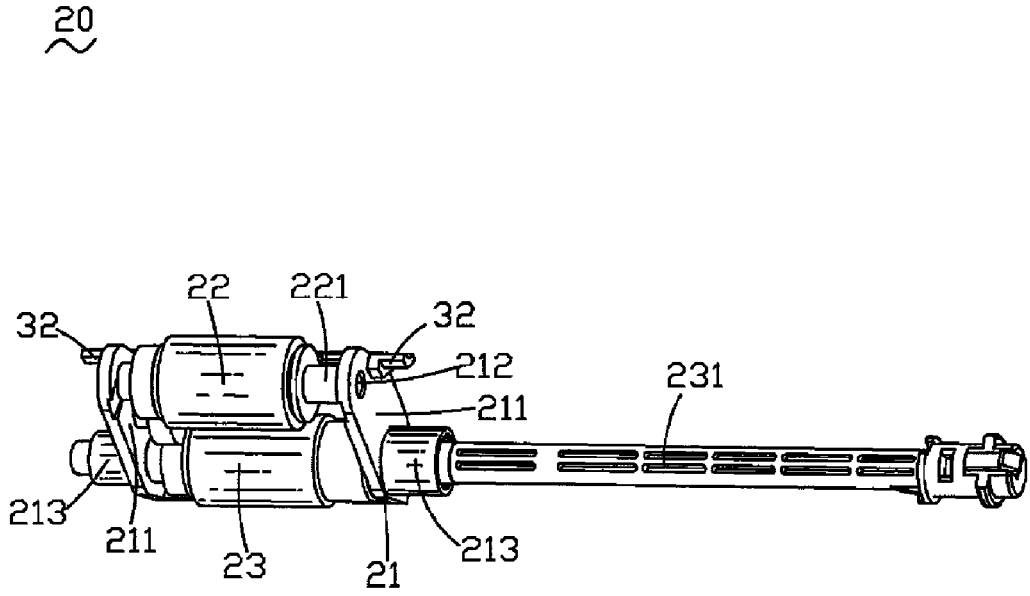
FIG. 4 is a perspective view of a pickup roller assembly of the paper feeding device.

Referring to FIGS. 3-4, the pickup roller assembly 20 includes a roller frame 21, a pickup roller 22 and a separating roller 23. The roller frame 21 has two side walls 211, an idle shaft hole 212 is opened in the front side of each side wall 211 and an active shaft hole (not shown) is opened in the back side of the side wall 211. A retaining tube 213 projects from the outer surface of the side wall 211 around the active shaft hole.

The pickup roller 22 has an idle shaft 221, the separating roller 23 has an active shaft 231. Two ends of the idle shaft 221 are connected to the two idle shaft holes 212 respectively, the two active shafts 231 are connected to the active shaft holes and the retaining tubes 213 respectively.

Figure 5:
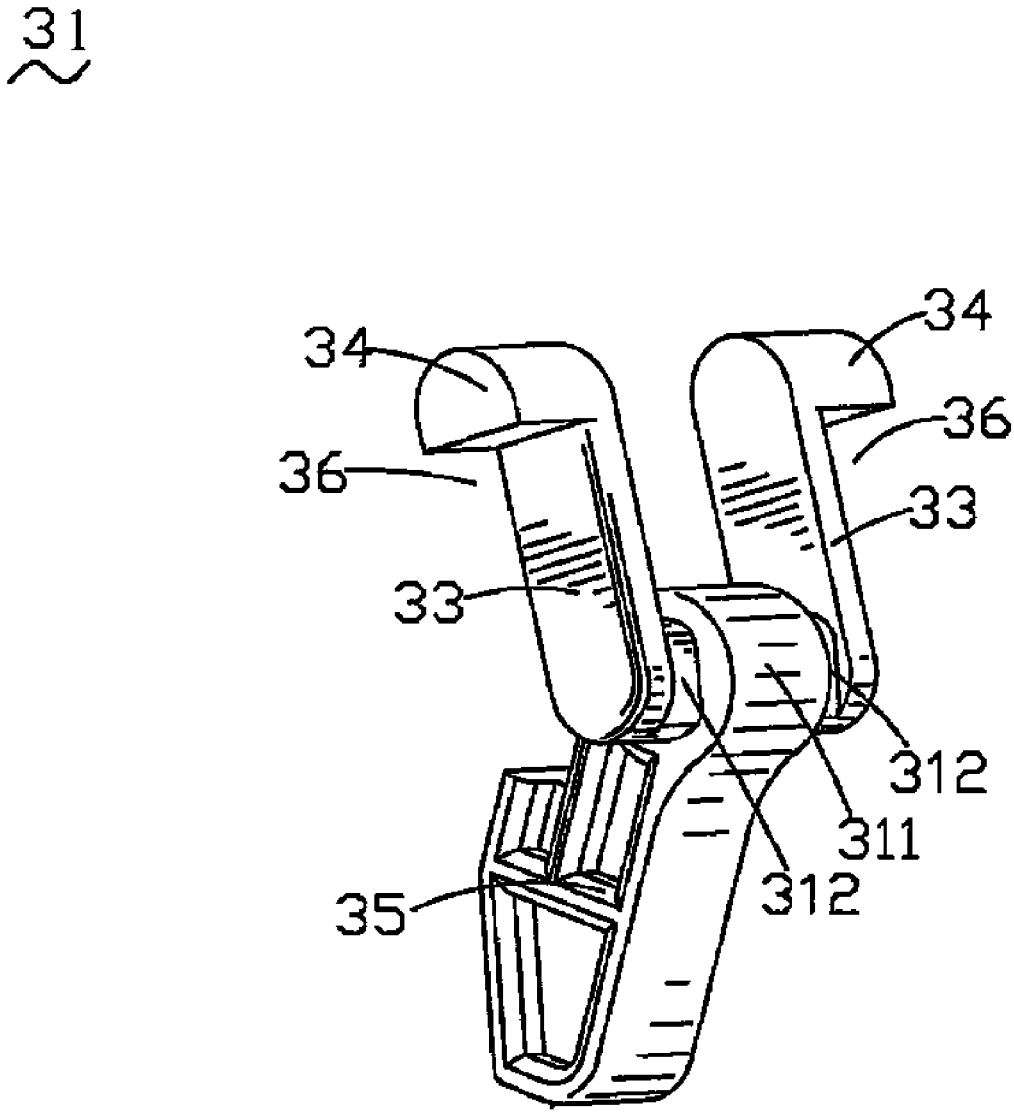
FIG. 5 is a perspective view of a paper blocking element shown in FIG. 3.

Please refer to FIG. 3 and FIG. 5, the paper blocking unit 30 includes a paper blocking element 31 and a projection 32. The paper blocking element 31 has a connecting portion 311, two opposite sides of the connecting portion 311 project outward to form a pivot 312 respectively. The outer end of the pivot 312 extends upward to form a connecting arm 33, the width of the pivot 312 is smaller than that of the connecting portion 311 and the connecting arm 33. The top end of the connecting arm 33 is arc-shaped and projects outward to form a half-cylindrical blocking portion 34, and then a passage 36 is defined between the blocking portion 34 and the connecting arm 33. The bottom of the connecting portion 311 extends downwards and forms a paper blocking arm 35. The projection 32 is mounted on the front of the upper portion of the side wall 211, the projection 32 can stop at the blocking portion 34 or pass through the passage 36 below the blocking portion 34.

Then please refer to FIG. 3, at least one retaining board 52 is mounted on each of the two opposite sides of the inner surface of the cover 50. In this embodiment, a pair of parallel retaining boards 52 are mounted on each of the two opposite sides. The middle portion of the front edge of the retaining board 52 is cut inwards to form a L-shaped retaining ditch 521, the bottom end of the retaining ditch 521 extends to the lower portion of the retaining board 52 and is arc-shaped. The two retaining boards 52 at one side each defines a retaining hole 522 behind the retaining ditch 521. The inner surface of the cover 50 has a mating board 53 extended at the outside of the two retaining boards 52 and is parallel to the retaining board 52. A hole is opened in the mating board 53 corresponding to the retaining hole 522. A mating tube 531 projects from the outer surface of the mating board 53 around the hole. The inner one of the two retaining boards at the other side defines a retaining hole 522 at the same position as the other pair of retaining boards 52.

Please refer to FIG. 1, FIG. 4 and FIG. 5, the assemblage of the paper feeding device 1 of the present invention is described in detail hereinafter. Firstly, the pickup roller assembly 20 is connected to the cover 50, one end of the active shaft 231 passes through the retaining tube 213, the retaining holes 522 and the mating tube 531, the other end of the active shaft 231 projects out of the retaining tube 213 and then is connected to the retaining hole 522. The pickup roller assembly 20 can rotate around the active shaft 231. The paper blocking element 31 is connected to the two retaining ditches 521 at the same side, the connecting portion 311 is located between the two retaining boards 52, the pivot 312 is clipped in the retaining ditch 521, the bottom of the pivot 312 contacts with the bottom end of the retaining ditch 521, and the paper blocking element 31 is rotatablely around the pivot 312 in the retaining ditch 521. The cover 50 is covered on the base 10 and a space is formed therebetween for receiving the pickup roller assembly 20, then the lower portion of the paper blocking arm 35 is located in the cavity 12 of the base 10.

Figure 8:
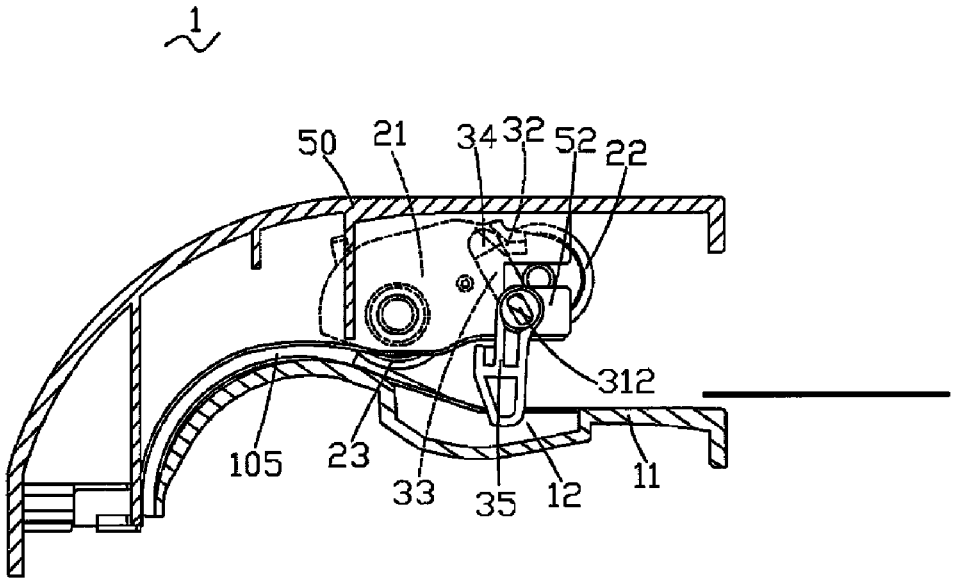
FIGS. 8-11 are side cross-sectional views for describing operations of the paper feeding device of the present invention.

The operation of the paper feeding device 1 of the present invention is described in detail hereinafter. Please refer to FIG. 8, when a paper-picking signal is not detected, the paper feeding device 1 is in natural state, the pickup roller 22 keeps a certain distance from the paper. The lower portion of the paper blocking arm 35 is received in the cavity 12 of the base 10, the blocking portion 34 of the paper blocking element 31 is upward against the projection 32 mounted on the side wall 211. When the paper is loaded on the paper loading base 11 and contacts with the paper blocking arm 35, as the blocking portion 34 is stopped at the projection 32, the paper blocking arm 35 isn't able to rotate and the paper is stopped outside by the paper blocking arm 35.

Figure 9:
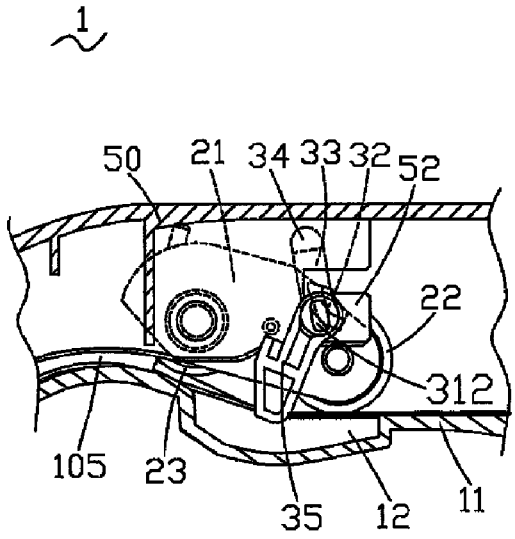
Figure 10:
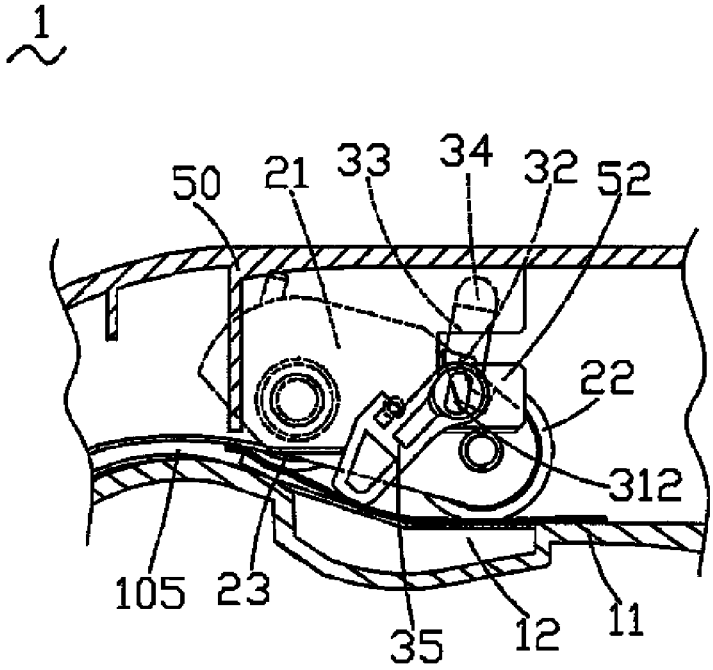

Please refer to FIGS. 9-10, when a paper-picking signal is detected, the paper feeding device 1 picks up the paper, the pickup roller assembly 20 is driven to rotate clockwise around the active shaft 231, so the pickup roller 22 moves downwards. Meanwhile, as the pickup roller assembly 20 moves downwards, the projection 32 mounted on the side wall 211 also moves downwards and passes through the passage 36 of the paper blocking element 31, so the projection 32 loses the cooperation with the blocking portion 34 of the paper blocking element 31, the paper blocking arm 35 no longer stop the paper. Then the pickup roller 22 contacts with the paper, the paper is fed into the paper feeding device 1 by the pickup roller 22 and the separating roller 23 and pushes the paper blocking arm 35 to rotate clockwise around the pivot 312.

Figure 11:
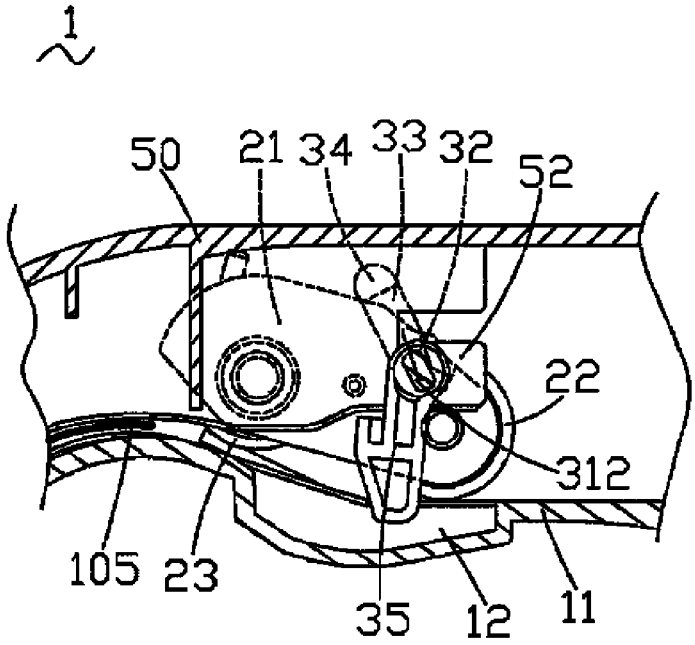

When the paper feeding device 1 stops picking papers, the active shaft 231 is driven to rotate anti-clockwise, so the pickup roller 22 rotates anti-clockwise and departs from the paper. The paper blocking element 31 rotates anti-clockwise around the pivot 312 under its own weight, meanwhile, the projection 32 mounted on the side wall 211 of the pickup roller assembly 20 passes through the passage 36 (shown in FIG. 5) of the paper blocking element 31 and stops at the blocking portion 34 again. As shown in FIG. 11, the paper feeding device 1 is in natural state, the papers are stopped outside by the paper blocking arm 35.

As described above, the paper feeding device 1 stops the papers 2 by the cooperation between the paper blocking element 31 and the projection 32. When to feed papers, the projection 32 passes through the passage 36 of the blocking element 31 to allow the paper to be fed in, so the cooperation is easy, the paper feeding device 1 works smoothly.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A paper feeding device, comprising:

a cover;

a base having a paper loading base at the front portion for loading papers, the cover covering the base, and a paper transporting passage being formed between the cover and a back portion of the base;

a pickup roller assembly having two side walls, the pickup roller assembly picking up the paper and then transferring the paper into the paper transporting passage of the paper feeding device; and at least one paper blocking unit placed beside the pickup roller assembly, the paper blocking unit having a paper blocking element and a projection projecting from the upper portion of the side wall of the pickup roller assembly, the paper blocking element having a connecting portion, a pivot projecting outward from the two opposite sides of the connecting portion and rotatablely connecting the cover, a connecting arm extending upwards from the outer end of the pivot, a blocking portion projecting outwards from the outer side of the top end of the connecting arm, a passage being formed between the blocking portion and the connecting arm, a paper blocking arm extending downwards from the connecting portion, wherein two opposite sides of the inner surface of the cover extends a pair of retaining boards respectively, the middle portion of the front edge of the retaining board is cut inwards to form a L-shaped retaining ditch, the end of the retaining ditch extends to the lower portion of the retaining board and is arc-shaped, the connecting portion of the paper blocking element is located between the two retaining boards at the same side, the pivot is clipped in the retaining ditch, the bottom of the pivot contacts with the end of the retaining ditch, and the paper blocking element is rotatablely around the pivot in the retaining ditch.

2. The paper feeding device as claimed in claim 1, wherein the paper loading base defines a pair of long cavities lengthwise, the lower portion of the paper blocking element is located in the cavity.

3. The paper feeding device as claimed in claim 1, wherein the pickup roller assembly includes a roller frame, a pickup roller and a separating roller, an idle shaft hole is opened in the front side of each side wall and an active shaft hole is opened in the back side of the side wall, the separating roller has an active shaft connected to the active shaft hole, the pickup roller assembly can rotate around the active shaft.

4. The paper feeding device as claimed in claim 3, wherein a mating board is extended from the outside of the inner surface of the cover and is parallel to the retaining board, one end of the active shaft passes through the retaining boards and the mating board, the other end of the active shaft is connected to another retaining board.

* * * * *